US006796628B2

(12) United States Patent
Miller

(10) Patent No.: US 6,796,628 B2
(45) Date of Patent: Sep. 28, 2004

(54) CONTOUR CORRECTING PRINTER

(75) Inventor: John P. Miller, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 23 days.

(21) Appl. No.: 10/289,773

(22) Filed: Nov. 7, 2002

(65) Prior Publication Data

US 2004/0090478 A1 May 13, 2004

(51) Int. Cl.[7] ..... B41J 29/38
(52) U.S. Cl. ..... 347/14; 347/19
(58) Field of Search ..... 347/2, 14, 19; 101/35

(56) References Cited

U.S. PATENT DOCUMENTS 5,043,740 A * 8/1991 Kneezel et al. ..... 347/12
5,366,301 A 11/1994 Martin et al. ..... 400/56
5,576,744 A 11/1996 Niikura et al. ..... 347/14
5,806,992 A 9/1998 Ju ..... 400/56
5,820,283 A 10/1998 Sunada et al. ..... 400/642
6,409,294 B1 * 6/2002 Zimmermann et al. ..... 347/2
2001/0017085 A1 * 8/2001 Kubo et al. ..... 101/35

FOREIGN PATENT DOCUMENTS

EP 925 928 A2 * 6/1999 ..... B41J/2/05
EP 953 454 A2 * 11/1999 ..... B41J/3/407

* cited by examiner

*Primary Examiner*—Lamson Nguyen
*Assistant Examiner*—Blaise Mouttet
(74) *Attorney, Agent, or Firm*—Ronald Reichman; Angelo N. Chaclas

(57) ABSTRACT

Some embodiments of the present invention are directed to systems and methods to facilitate printing on a media surface. For example, a topography of a print surface on a media may be determined. A firing time of a print nozzle may then be adjusted based upon the determined topography.

18 Claims, 8 Drawing Sheets

700

| 701 NOZZLE | 702 NOZZLE FIRE | 703 TIME | 704 TIME TO FIRE DELTA |
|---|---|---|---|
| 1 | Y | 0.01 | 5ms |
| 2 | Y | 0.01 | 8ms |
| 3 | N | 0.01 | 2ms |

Fig. 7

CONTOUR CORRECTING PRINTER

BACKGROUND

This invention relates generally to ink jet printers, and, more particularly, to a mailing machine, including a printing device for printing on a surface that is not flat, such as an envelope.

Ink jet printing mechanisms are well known and have been adapted to a variety of applications and devices, such as: office printers, point of sale devices and postage metering systems. Generally, ink jet printing mechanisms include a print head with multiple ink jet nozzles. Each ink jet nozzle ejects a series of ink drops onto paper or other medium, each drop creating a dot on the paper, until a desired image is achieved.

Typically, a mailing machine utilizes the ink jet printing mechanism in conjunction with a postage metering system included in the mailing machine for dispensing postage. The dispensed postage can be represented as a digital postage indicia which can include a two-dimensional barcode. Automatic processing of a mailpiece requires that the two-dimensional barcode be scanned with a barcode optical recognition device. Accordingly, to be properly scanned, a barcode or other printed image cannot be distorted as viewed from a position normal to the mailpiece.

However, the surface of an envelope traversing a mailing machine typically will not be flat. Placing ink jet dots on a surface that is not flat can cause irregularities and distortions. Distortions can occur, for example, when an irregular topography on a printing surface results in some ink droplets emitted from ink jet nozzles to have a longer fly time than other ink droplets. The transport speed of the mailing machine will continue to move the mail piece at transport speed during the fly time of the ink droplets. The combination of the transport speed and the increased fly time of one droplet relative to another droplet causes a printed image to be warped as viewed from a normal position.

Therefore, it would be advantageous to provide apparatus and methods that overcame the drawbacks of the prior art. In particular, it would be desirable to provide apparatus and methods that facilitate accurate printing of an image on an uneven print surface.

SUMMARY

Accordingly, to alleviate problems inherent in the prior art, the present invention introduces systems and methods to facilitate printing on a media surface.

According to some embodiments, a topography of a print surface on a media is determined. A firing time of a print nozzle is then adjusted based upon the determined topography.

Additional aspects and advantages of the invention will set forth in the description that follows, and in part will be obvious from the description, or may be learned by practice of the invention. Various features and embodiments are further described in the following figures, descriptions and claims.

BRIEF DESCRIPTION OF THE DRAWINGS

The accompanying drawings illustrate some embodiments of the invention, and together with the general description given above and the detailed description given below, serve to explain the principles of the invention. As shown throughout the drawings, like reference numerals designate like or corresponding parts.

FIG. 7 illustrates an exemplary database that can be utilized while practicing the present invention.

DETAILED DESCRIPTION

The present invention includes apparatus and methods for printing on a printing surface that is not flat. In particular, the present invention includes apparatus and methods to facilitate accurately placing ink jet droplets on a printing surface that is not flat, such as, for example, on a surface of an envelope. The topography of the print surface is determined and firing of multiple ink jet nozzles is coordinated based upon the topography. For the purposes of this invention, the topography of a print surface can include indications of elevations, inequalities and other configurations or aberrations on a print surface.

Figure 1:
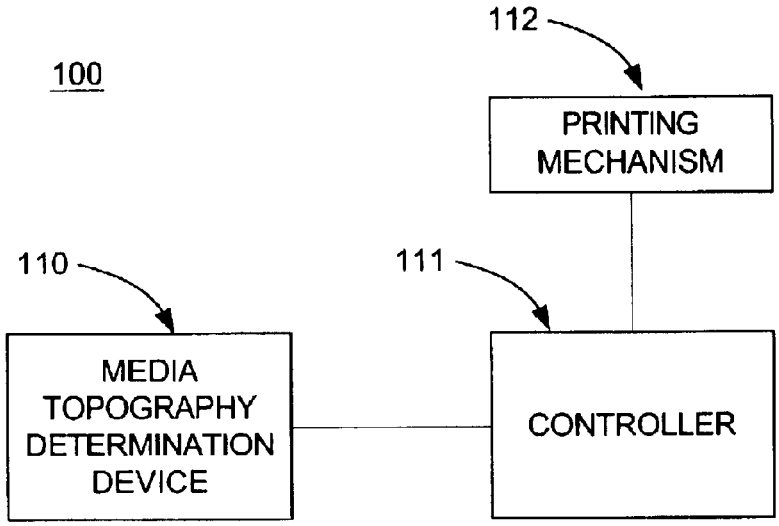
FIG. 1 illustrates a block diagram of embodiments of the present invention.

Referring now to FIG. 1, a media topography determination device 110 is utilized in conjunction with a controller 111 and a printing mechanism 112 to control printing according to variations on a print surface of a media. The media topography determination device 110 can include electro mechanical and/or electronic devices which can capture variations in a print surface wherein the variations indicate that the print surface is other than flat at a magnitude great enough to affect the print quality of a machine readable code that will be printed on the print surface. The controller 111 can include an electronic device capable of receiving data from the media topography determination device 110 and modifying printing performed by the printing mechanism 112 according to the received data. The printing mechanism 112 can include an ink jet printer with multiple nozzles which fire at controlled times in order to create a desired print pattern on the print media.

Data indicative of the topography of the print surface is generated by the media topography determination device 110 and transmitted to the controller 111. The controller 111 can correlate the data received from the media topography determination device 110 with one or more particular ink jet nozzles that are included in a printing mechanism 112. The controller 111 can also control firing of the one or more ink jet nozzles based upon a pattern that will be printed and the topography of the print surface.

Figure 2:
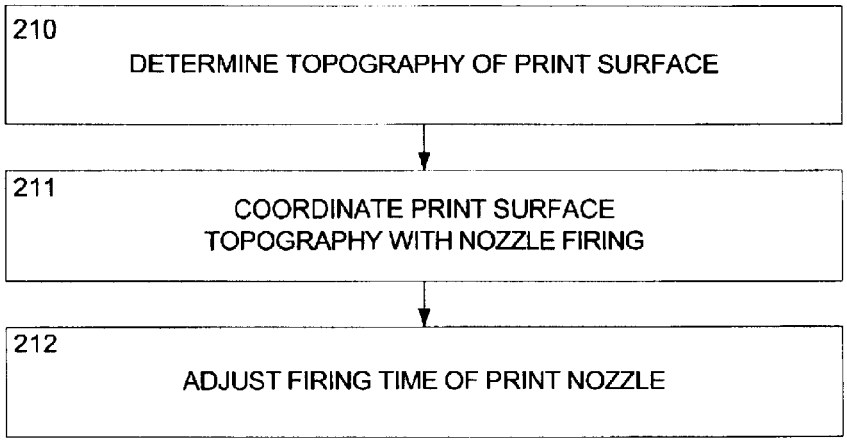
FIG. 2 illustrates method steps that can be completed while practicing the present invention.

Referring now to FIG. 2, steps are illustrated that can be performed while practicing the present invention. At 210, the topography of a print surface of a media which will be printed upon is determined. The topography can be determined, for example, just prior to the print surface being printed upon. At 211, the topography of the print surface is coordinated with the firing of one or more nozzles, and at 212 the firing time of one or more print nozzles is adjusted.

Figure 3:
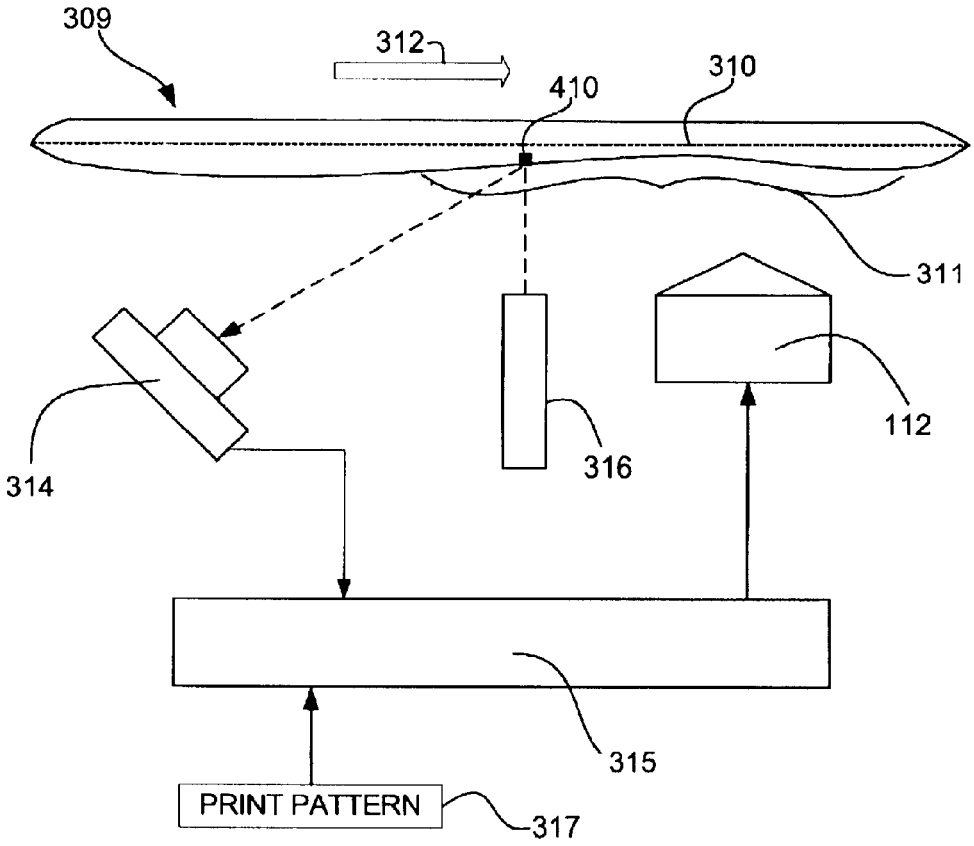
FIG. 3 illustrates an apparatus that can be utilized to determine the topography of a print media.

Referring now to FIG. 3, a block diagram illustrates various components that can be included in some embodiments of the present invention. In particular, a mailpiece 309 (e.g., an envelope) can move in a direction 312 along a transport of a mailing machine. The mailpiece 309 can have an edge 310 and a print surface 311, and the print surface 311 may have variations in its topography. For example, the mailpiece 309 may extend outward from the edge 310 due to inserts into the mailpiece 309. As a result, the print surface 311 may not be planar. That is, the print surface 311 may have variations in its topography, or otherwise be non-planar along the direction of movement 312. Note that variations in the direction of movement may be caused by manipulation of the mail piece 309 by a mailing machine transport. Variations in topography may also include a skewed mail piece 309 or other aberration that causes one point of a print surface to be at a higher elevation than another point in relation to a print nozzle.

A printing mechanism 112 for printing on the print surface 311 can include an inkjet printer with a plurality of ink jet nozzles which fire droplets of ink at the print surface 311 as the mailpiece 309 passes in front of the printing mechanism 112. Embodiments, such as a mailing machine, can include multiple ink jet nozzles that are stationary in relation to the mail piece 309. In this case, printing is accomplished along the print surface 311 while the mail piece 309 moves past the printing mechanism 112.

Timing of firing of individual ink jet nozzles can be controlled by a controller 315. The controller 315 can adjust the timing of individual ink jet nozzles based upon a print pattern 317 processed by the controller 315 and an indication of the topography of the print surface 311 received from a media topography determination device 110. The print pattern 317 can include a representation of an image that is to be printed, such as, for example, a postage indicia.

In some embodiments, topological variations are determined by projecting an image 410 (FIGS. 4*a* and 4*b*)such as a line on the print surface 311 with a light source 316, such as a laser. A resulting image can be viewed with an image receptor 314, such as, for example, a two dimensional camera positioned to view the image at an angle from the direction of the light source to the print surface 311. For example, the camera can view the image from a position that is approximately 45 degrees from the path of the light projected onto the print surface 311. The viewed image 410 can be analyzed for distortions that would be caused by a non-planar surface, such as a wavy envelope, or other irregular surface. Note there may be a trade-off between the angle of the camera and the proximity of the laser line to the print line. For example, when the topography of an envelope surface is always changing, an increased distance between the print head and the scanner may let more error be introduced. On the other hand, print dots that need to be delayed may already have been fired if the laser is too close to the print line. Moreover, placing the camera further from vertical may result in a higher resolution interpretation of a surface's topography. According to some embodiments, the camera is placed at substantially 45 degrees from the vertical.

An amount of distortion to a particular portion of the projected image 410 can be utilized to calculate an adjusted firing time for a particular nozzle to compensate for the distortion. The adjusted firing time can facilitate ink droplets corresponding with a particular portion of an image 410 such that the droplets contact the print surface 311 at approximately the same time. As a result distortion to the printed image may be reduced.

Figure 4A:
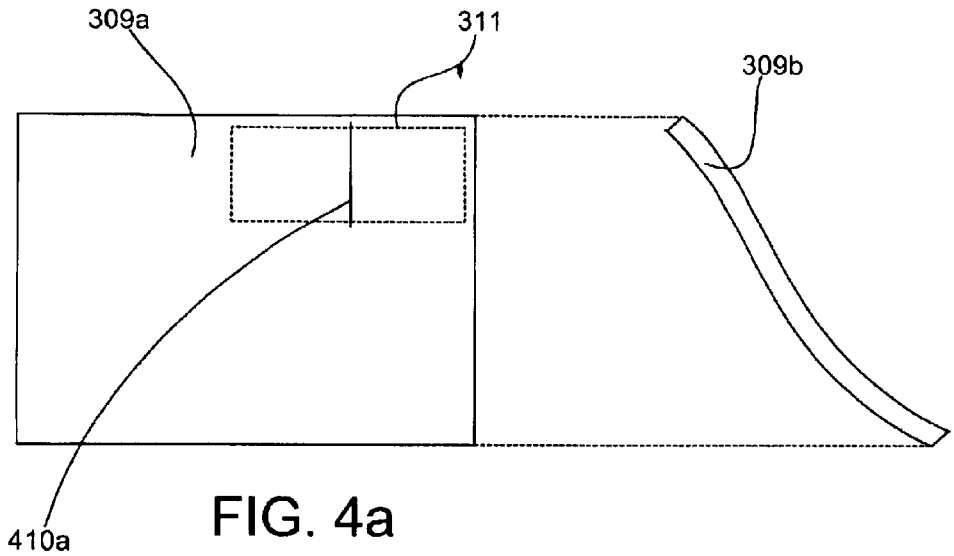
FIG. 4*a* illustrates a print media from a normal view and a perspective view and an image projected on the print media.
Figure 4B:
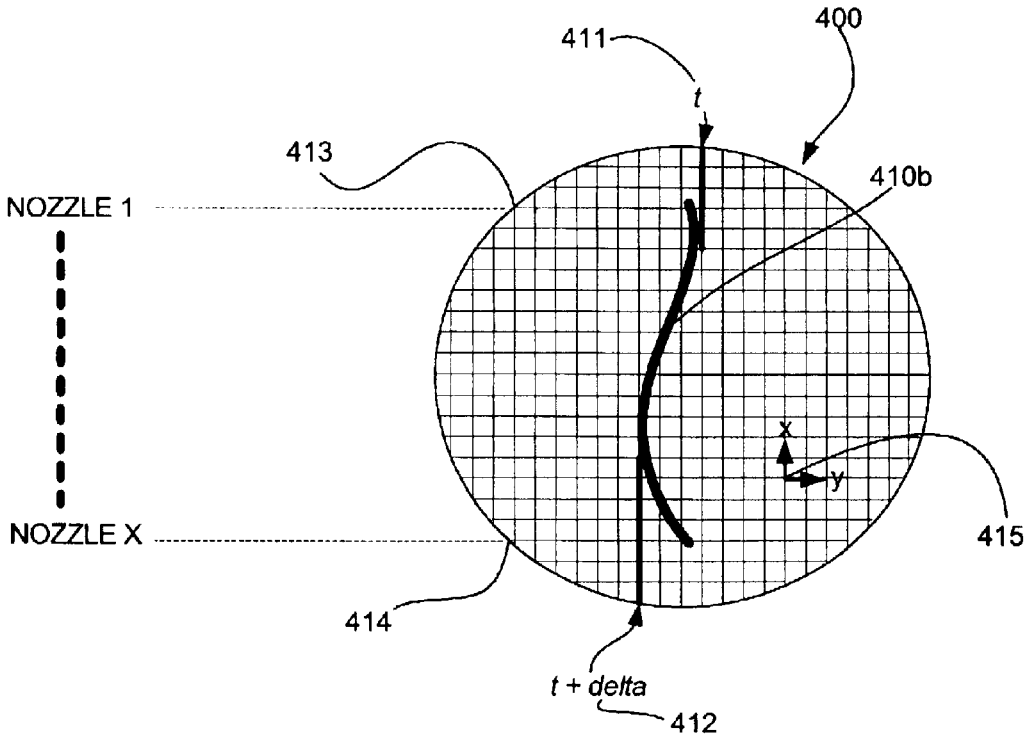
FIG. 4*b* illustrates the perspective view of the projected-image overlaid with a grid indicating firing nozzles and relative time delays.

Referring now to FIGS. 4*a* and 4*b*, an example is provided of an image 410 that can be utilized to determine the topography of a print surface 311 on a media 309*a*. The image can be projected, for example, with a laser light. In particular, a projected image of a line 410*a* is illustrated as viewed from a position normal to the print surface 311. From a normal viewpoint, the line 410*a* appears straight. However, a profile 309*b* of the media illustrates that the media is not planar. Consequently, if the projected image 410*a* is viewed from a position other than normal to the print surface 311, the variations in the print surface's topography can be determined through the distortion to the projected image 410, as illustrated by the distorted line 410*b*.

The camera 314 can view the projected image 410 from a position other than normal to the print surface 311 and capture a representation of the projected image 410*b*, including distortions. The camera 314 can transmit the representation of the distorted projected image 410*b* to the controller 315 for analysis.

During analysis, the controller 315 can plot the projected image 410*b* on a graph 400. The graph of the projected image 410*b* will be indicative of the topography of the print surface 311. Various points on the projected image 410*b* can also be associated with corresponding nozzles, such as nozzle 1 at 413 through nozzle x at 414. A point that is associated with a nozzle 413–414, can also be associated by the controller 315 with a time (t) 411 or a time plus delta (t+delta) 412 (e.g. along the x axis).

The controller 315 can adjust the firing time for a particular nozzle 413–414 according to the time t 411 or the time plus a delay t plus delta 412 associated with the particular nozzle 413–414. Firing time for each print nozzle 413–414 can be adjusted such that droplets of ink fired from multiple print nozzles 413–414 will strike the print surface simultaneously, or at least within a close enough time proximity to minimize distortion to a printed pattern.

A nozzle 413–414 can be associated with a time 411 or a time plus a delta 412, for example, by charting the nozzles 413–414 along the x axis of a grid 415 and the time 411 and time plus a delta 412 along the y axis of the grid 415. The distorted projected image 410*b* can be plotted on the grid 415 and points from the plotted image 410*b* can be correlated with nozzles 413–414 such that a time to fire can be determined based upon the correlation of the plotted image and the time t 411 or time plus delta 412 charted. Time t 411 can be placed on the graph at any point that can serve as a relevant reference for the plotted image 410*b*, such as, for example, at a point that correlates with a rightmost edge of the image 410*b*.

Figure 5:
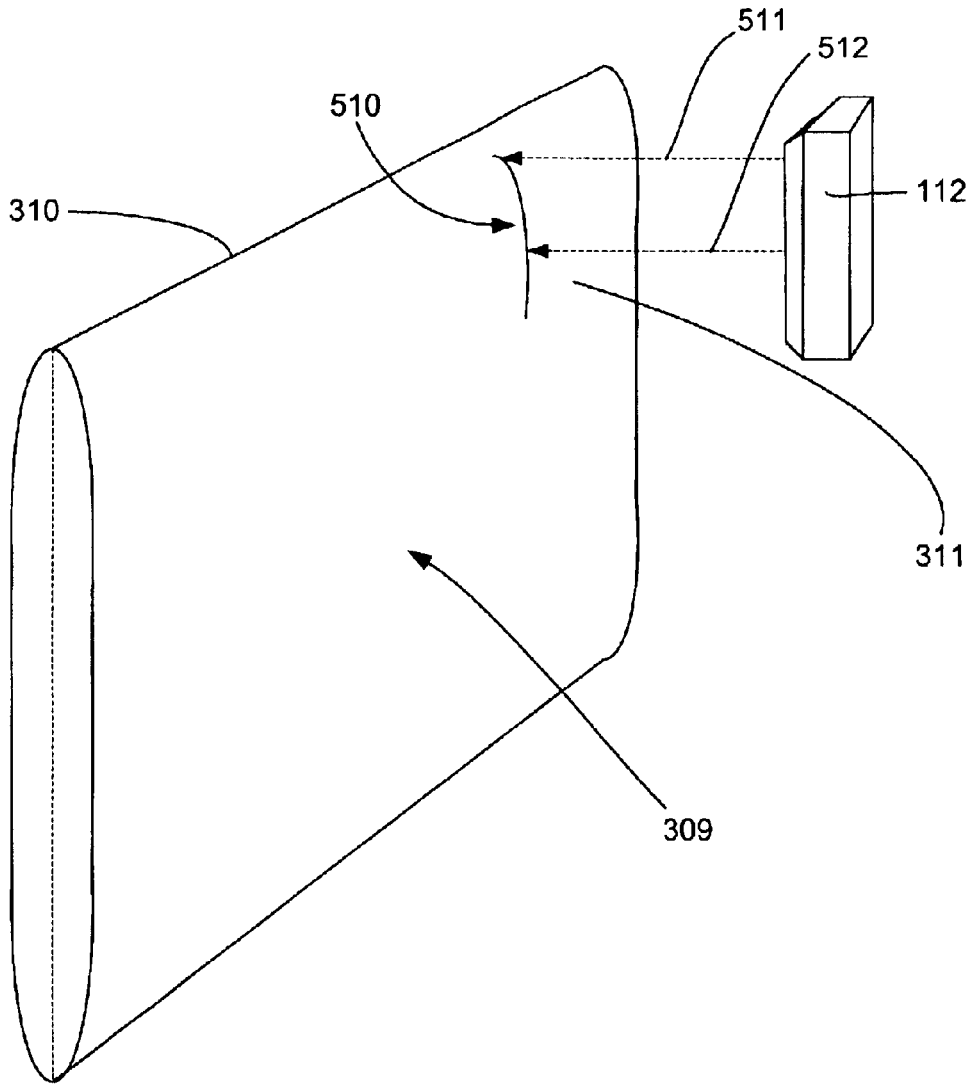
FIG. 5 illustrates an envelope and ink jet streams according to an embodiment of the present invention.

Referring now to FIG. 5, a perspective view of a print media 309 and a printing mechanism 112 is illustrated. A pattern 510 can be printed on the media 309 with ink droplets 511–512 fired from the printing mechanism 112 which includes an ink jet printer. The print media 309 can include an envelope or other media 309 that slopes to an edge. Consequently, an ink droplet 511 that hits the print surface 311 closer to the edge may have a longer fly time than an ink droplet 512 that hits further from the edge. The droplet that hits closer to the edge 511 will therefore have a firing time closer to t 411 and the droplet 512 will have a firing time of t plus delta such that both droplets 511 and 512 will contact the print surface 311 at approximately the same time even though droplet 512 has a shorter fly time than the droplet 511.

For example, an ink droplet 511–512 may have fly time of approximately 0.50 mSec. However, because of topographical differences on a print surface 311, a first ink droplet 511 may have a fly time to 0.52 mSec and a second droplet 512 may have a fly time of 0.46 mSec. The present invention can detect the topographical differences, advance the firing of the first nozzle by 0.02 mSec, and delay firing of the second droplet by 0.04 mSec causing the droplets to simultaneously contact the print surface 311.

Ink drops contacting the print surface 311 at approximately the same time can result in a minimal amount of distortion to the printed pattern 510. Minimal distortion to a printed pattern 510 can be particularly important when rendering a machine-readable barcode or the like.

Figure 6:
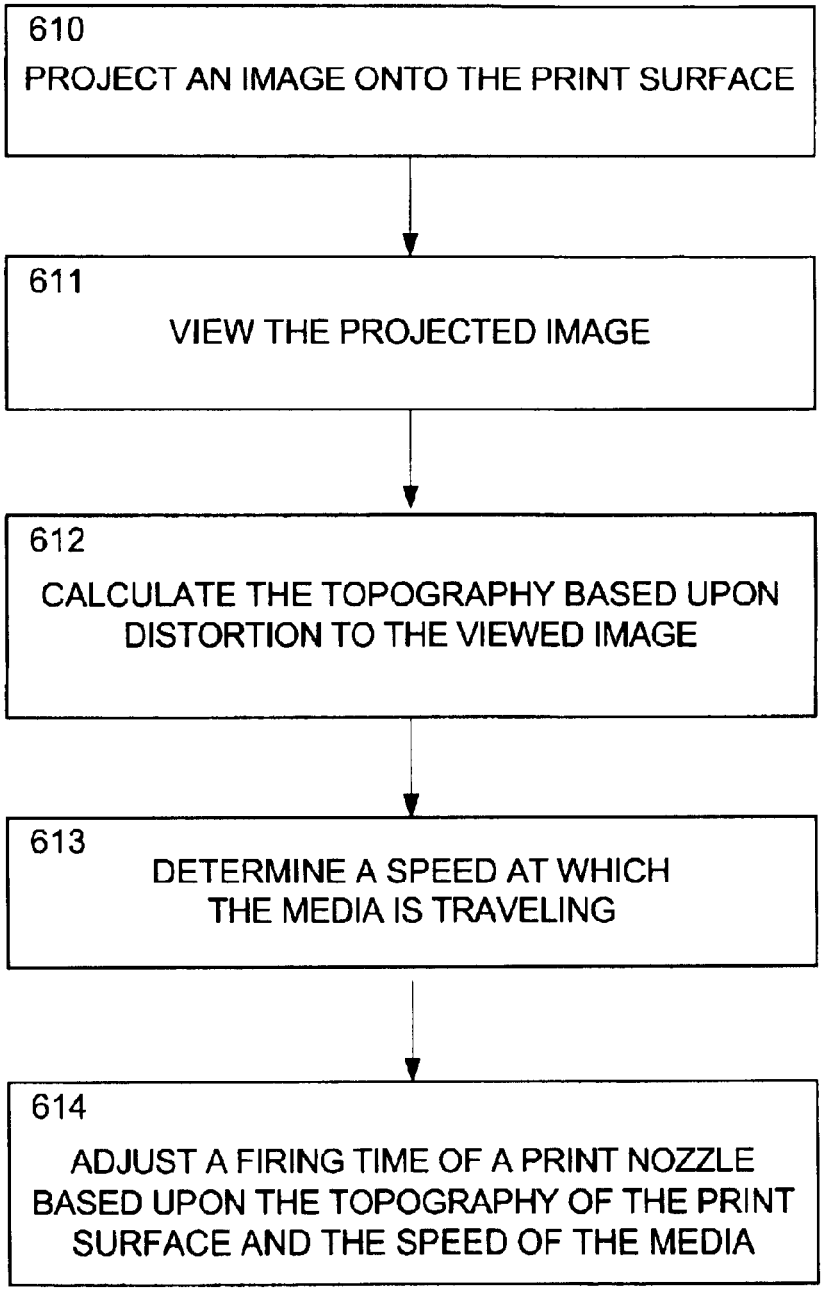
FIG. 6 illustrates a flowchart of exemplary steps that can be performed while implementing the present invention.

FIG. 6 illustrates a block diagram of steps that can be implemented while practicing some embodiments of the present invention. At 610 an image 410 can be projected on the print surface 311. The projected image 410 can include, for example, a line projected by a laser 316. At 611 the image 410 can be viewed. Viewing can be accomplished with an image receptor, such as, for example, a digital two-dimensional image camera 314 capable of capturing an image and generating a digital signal representative of the captured image or other type of image receptor. Distortion to the image 410 may be captured, for example, when the image 410 is viewed from a position other than a position normal to the print surface 311.

At 612 the topography can be calculated based upon distortion to the viewed image. At 613, the speed at which the media is traveling can be determined. In some embodiments, a speed at which a media will travel, such as, for example, an envelope traveling along the transport of a mailing machine, can be a predetermined speed. In such embodiments, the speed will be a constant which can be factored into any pertinent calculations. In other embodiments, the speed at which the envelope will travel along the transport of the mailing machine may be adjustable, or vary according to conditions. Therefore, in some embodiments, the speed at which the media is traveling can be determined if such determination facilitates optimum adjusting of the firing time of a print nozzle.

At 614, the firing time of one or more print nozzles can be adjusted, based upon the topography of the print surface 311 and the speed of the media. For example, a plotted graph 400 of a projected image 410*b* can represent the topography of a print surface 311 and indicate that a time delay (t+delta) should be implemented for some print nozzles 413–414 in order to facilitate simultaneous contact of the print surface 311 by ink droplets 511–512.

Referring now to FIG. 7, a database 700 that can be utilized in conjunction with the present invention can include fields of data associated with various aspects of control of a printer mechanism 112. For example, a database 700 can include a data field associated with a printer nozzle 701. The printer nozzle data field 701 can also be associated with a data field 702 indicative of whether a nozzle 413–414 will fire. Another field 703 can include a time for a first time to fire. Still additional data fields can contain data indicative of whether a nozzle is to be associated with a timing change or delta 704.

Figure 8:
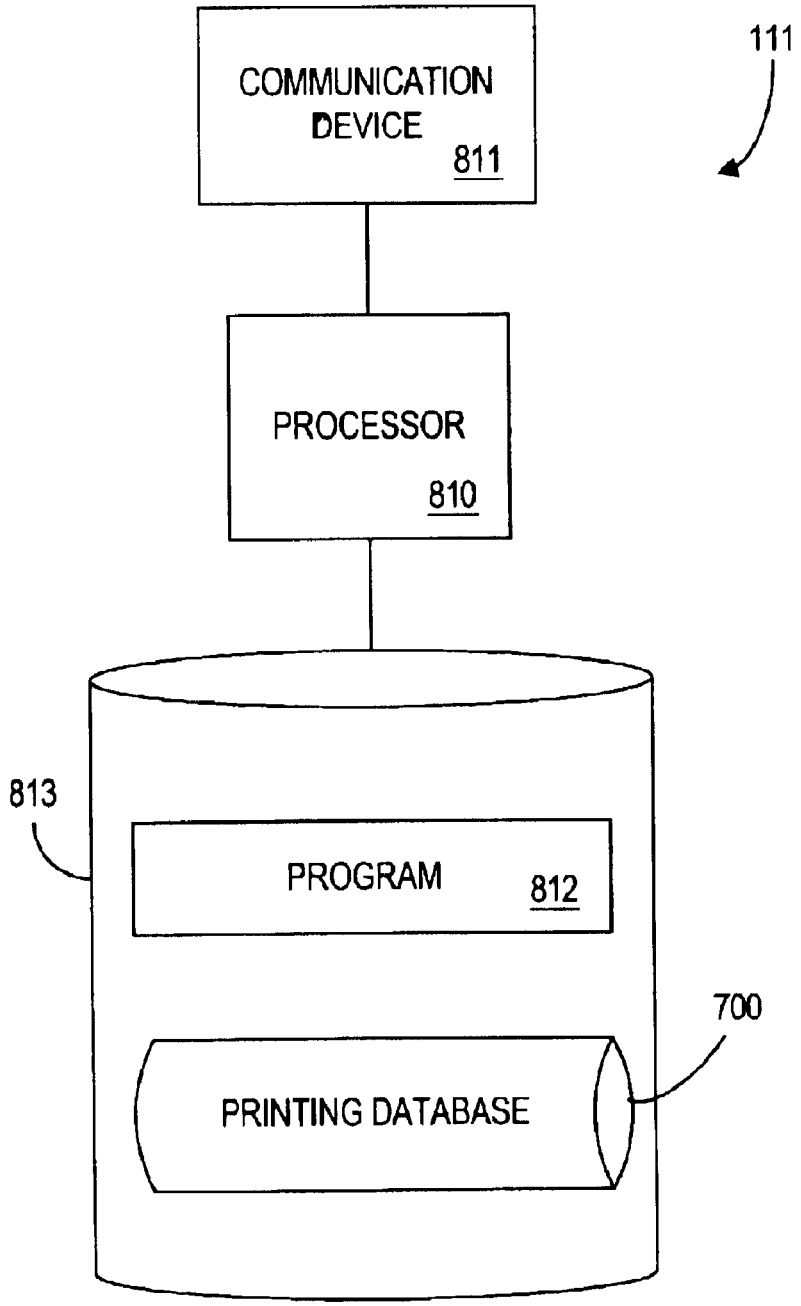
FIG. 8 illustrates a block diagram of a controller that can be utilized with the present invention.

FIG. 8 illustrates details of a controller 111 represented in a block diagram. The controller 111 may include a processor, microchip, central processing unit, or computer 810 that is in communication with or otherwise uses or includes one or more communication ports 811 for communicating with the printing mechanism 112, media topography determination device 110 and/or other devices. A communication port 811 may include such things as a universal serial bus port, wireless communication circuitry, Bluetooth technology, etc.

In addition to the above, the controller 111 may include a memory or data storage device 813 to store information, software, databases, communications or other information. The memory or data storage device 813 preferably comprises an appropriate combination of magnetic, optical and/or semiconductor memory, and may include, for example, Random Read-Only Memory (ROM), Random Access Memory (RAM), a tape drive, flash memory, a floppy disk drive, a compact disc and/or a hard disk.

The controller 111 may be capable of high volume processing, performing a significant number of mathematical calculations in processing communications and database searches. A Pentium™ microprocessor manufactured by Intel Corporation may be used for the processor 810. Equivalent processors are available from Motorola, Inc., AMD, or Sun Microsystems, Inc. The processor 810 also may comprise one or more microprocessors, computers, computer systems, etc.

Software may be resident and operating or operational on the controller 111. The software may be stored on the data storage device 813 and may include a control program 812 for operating the server, databases, etc. The control program 812 may control the processor 810. The processor 810 can perform instructions of the control program 812, and thereby operate in accordance with the present invention, and particularly in accordance with the methods described in detail herein. The control program 812 may be stored in a compressed, uncompiled and/or encrypted format. The control program 812 furthermore includes program elements that may be necessary, such as an operating system, a database management system and device drivers for allowing the processor 810 to interface with other devices, databases, etc. Appropriate program elements are known to those skilled in the art.

According to some embodiments of the present invention, the instructions of the control program 812 may be read into a main memory from another computer-readable medium, such as from ROM to RAM. Execution of sequences of the instructions in the control program 812 causes the processor 810 to perform the process steps described herein. In alternative embodiments, hard-wired circuitry may be used in place of, or in combination with, software instructions for implementation of some or all of the methods of the present invention. Thus, embodiments of the present invention are not limited to any specific combination of hardware and software.

The processor 810, communication device 811 and data storage device 813 may communicate or be connected directly or indirectly in a variety of ways. For example, they may be connected via a bus. While specific implementations and hardware configurations for a controller 111 have been illustrated, it should be noted that other implementations and hardware configurations are possible and that no specific implementation or hardware configuration is needed.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. For example, an image can be pre-printed on the mailpiece, prior to insertion of materials into the mailpiece. Other variations relating to implementation of the functions described herein can also be implemented. Accordingly, other embodiments are within the scope of the following claims.

What is claimed is:

1. A method for facilitating printing on a media comprising:

determining a topography of a print surface on the media;

projecting an image onto the print surface on the media;

viewing the projected image; and calculating the topography based upon distortion to the viewed image; and adjusting a firing time of a print nozzle based upon the determined topography.

2. The method of claim 1 wherein the firing times of multiple nozzles are adjusted so that an ink droplet from each nozzle contacts a corresponding print surface at approximately the same time.

3. The method of claim 1 wherein the image is viewed at an angle other than normal to the print surface.

4. The method of claim 3 wherein the image is viewed with a two-dimensional viewing device.

5. The method of claim 3 wherein the projected image comprises a line generated by a light source and the print nozzle is associated with a point on the line.

6. The method of claim 3 wherein the image is viewed at an angle approximately equal to 45 degrees from the direction from which the light is projected.

7. The method of claim 3 wherein the image is projected from a location approximately normal to the print surface on the media.

8. The method of claim 3 wherein the light source comprises a laser.

9. The method of claim 1 wherein the media comprises an envelope.

10. The method of claim 9 wherein the media is moving on a mailing machine transport.

11. The method of claim 1 additionally comprising the step of:

determining a speed at which the media is traveling.

12. The method of claim 1 wherein the print nozzle is stationary and the media moves past the print nozzle.

13. The method of claim 1 additionally comprising the step of printing a machine-readable code on the print surface.

14. An apparatus for printing on a media surface, the apparatus comprising:

means for determining a topography of a print surface;

a printer mechanism comprising multiple print nozzles for hung droplets of ink at the print surface, wherein the printer mechanism is positioned to print on a mailpiece moving on a mailing machine transport; and a controller operatively connected to the means for determining the topography of the print surface and the printer mechanism, wherein the controller transmits to the printer mechanism an indication of a time one or more print nozzles should fire the droplets of ink based upon the topography of the print surface and a print pattern.

15. The apparatus of claim 14, wherein the means for determining a topography of a print surface comprises:

a light source for projecting an image on a print surface; and an image receptor for capturing an indication of the projected image on the print surface.

16. The apparatus of claim 15, wherein the tight source comprises a laser.

17. The apparatus of claim 15, wherein the projected image comprises a line.

18. The apparatus of claim 15, wherein the image receptor comprises a two dimensional camera.

* * * * *